US009057323B2

(12) United States Patent
van den Brink

(10) Patent No.: US 9,057,323 B2
(45) Date of Patent: Jun. 16, 2015

(54) DRIVE SYSTEM WITH A ROTARY ENERGY-TRANSMISSION ELEMENT

(75) Inventor: Anthonie van den Brink, Westmaas (NL)

(73) Assignee: GRIEND HOLDING B.V., S-Gravendeel (NL)

( * ) Notice: Subject to any disclaimer, the term of this patent is extended or adjusted under 35 U.S.C. 154(b) by 1387 days.

(21) Appl. No.: 12/491,570

(22) Filed: Jun. 25, 2009

(65) Prior Publication Data

US 2009/0320799 A1 Dec. 31, 2009

(30) Foreign Application Priority Data

Jun. 25, 2008 (NL) ..... 2001721
Jun. 25, 2009 (NL) ..... 2002598

(51) Int. Cl.

| | |
|---|---|
| ***F01B 3/04*** | (2006.01) |
| ***F02B 71/00*** | (2006.01) |
| ***F01B 3/00*** | (2006.01) |
| ***F01L 11/02*** | (2006.01) |
| ***F02B 63/04*** | (2006.01) |
| ***F02B 71/04*** | (2006.01) |
| ***F02B 75/26*** | (2006.01) |
| ***F02B 75/28*** | (2006.01) |

(52) U.S. Cl.

CPC . *F02B 71/00* (2013.01); *F01B 3/04* (2013.01); *F01B 3/0094* (2013.01); *F01L 11/02* (2013.01); *F02B 63/04* (2013.01); *F02B 63/041* (2013.01); *F02B 71/04* (2013.01); *F02B 75/26* (2013.01); *F02B 75/28* (2013.01)

(58) Field of Classification Search

CPC .... F01B 3/0079; F01B 3/0091; F01B 3/0094; F01B 3/045; F01B 3/0032; F01B 3/005; F01B 3/0052; F01B 3/0064; F01B 3/0067; F01B 3/04; F02B 75/26

USPC . 123/45 R, 45 A, 43 C, 43 AA, 43 A, 46 SC, 123/46 E, 51 R, 46 R, 47 R, 47 A, 47 AA, 123/47 AB

See application file for complete search history.

(56) References Cited

U.S. PATENT DOCUMENTS

| | | | | | |
|---|---|---|---|---|---|
| 1,343,142 | A | * | 6/1920 | Kershaw | 123/47 R |
| 2,401,466 | A | * | 6/1946 | Davis et al. | 123/51 BC |
| 3,584,610 | A | * | 6/1971 | Porter | 123/54.3 |
| 4,553,506 | A | * | 11/1985 | Bekiaroglou | 123/45 R |
| 4,834,033 | A | * | 5/1989 | Larsen | 123/56.8 |
| 5,351,657 | A | * | 10/1994 | Buck | 123/43 C |
| 5,375,567 | A | * | 12/1994 | Lowi, Jr. | 123/56.8 |

(Continued)

*Primary Examiner* — Lindsay Low
*Assistant Examiner* — Jacob Amick
(74) *Attorney, Agent, or Firm* — Young & Thompson

(57) ABSTRACT

The invention relates to a drive system provided with a cylinder shell with two end sections and, inside said cylinder shell, a central combustion chamber with two piston bodies arranged therein, that are displaceable in axially opposed directions within said combustion chamber, wherein a drive rod extending along the longitudinal axis of the cylinder shell is connected with each piston body and has a drive extension extending outwardly from each respective end section of said cylinder shell, wherein said drive rods are each connected via a drive element with a rotary body that can rotate around the cylinder shell, wherein said drive elements are provided with bearings that bear upon said rotary body and that, when in reciprocating motion, drive said rotary body in rotation about said longitudinal axis.

13 Claims, 10 Drawing Sheets

(56) References Cited

U.S. PATENT DOCUMENTS

Figure 1:
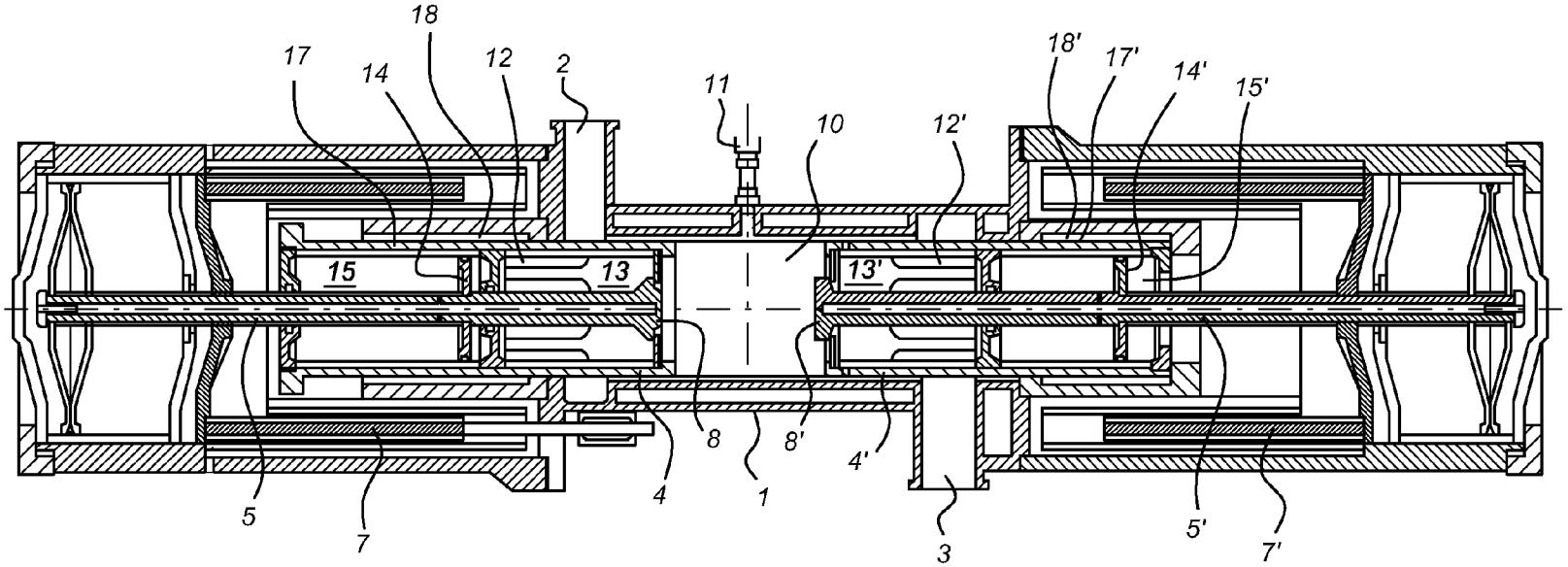

| | | | | |
|---|---|---|---|---|
| 7,284,510 | B2 * | 10/2007 | Schiestl et al. | 123/46 H |
| 7,721,685 | B2 * | 5/2010 | Page | 123/43 AA |
| 2005/0066917 | A1 * | 3/2005 | Huettlin | 123/45 A |
| 2005/0103287 | A1 * | 5/2005 | Hofbauer | 123/46 E |
| 2006/0283407 | A1 * | 12/2006 | Mann | 123/45 R |
| 2007/0029080 | A1 * | 2/2007 | Moyes | 166/179 |
| 2008/0079222 | A1 * | 4/2008 | Namuduri et al. | 277/359 |
| 2009/0308345 | A1 * | 12/2009 | Van den Brink | 123/197.1 |

* cited by examiner

DRIVE SYSTEM WITH A ROTARY ENERGY-TRANSMISSION ELEMENT

The invention relates to a drive system provided with a cylinder shell with two end sections and, inside the cylinder shell, a central combustion chamber with two piston bodies therein, which can move in axially opposed directions within the combustion chamber, wherein a drive rod extending along the longitudinal axis of the cylinder shell is connected to each piston body and extends outwardly from one respective end part of the cylinder shell with a drive end.

Such a drive system, which may comprise a generator, a combustion engine, an energy converter or a hybrid drive (combined generator/engine), is known from PCT/NL2007/050160. In the known energy converter, the cylinder encases a combustion chamber, inside of which two opposing oscillating piston bosses each drive a drive rod. The drive rods are displaceable in relation to the piston bosses and, at their face ends, are provided with a valve that is seated against a valve seat at an end face of the reciprocating piston bosses for the delivery of a fuel air mixture to and discharge of combustion gases from the central combustion chamber. The drive rods are connected to a magnetic element, such as a coil, that generates a voltage in the magnetic field of a stationary field coil. The piston bosses can be retained by means of a magnetic retaining element at the inner dead point (IDP) to open the inlet port, and at the outer dead point (ODP) to open the outlet port, so that said drive rods are displaced in relation to the piston bosses and the valves are displaced in relation to the valve seats in the piston bosses.

The known device, with a floating piston construction and gas dampers, has the drawback that the energy losses in the gas dampers are quite considerable. Control of the floating piston drive rods in conjunction with the displaceable piston bosses is complex and relatively unreliable.

The known oscillating energy converter is further subjected to relatively high accelerations that cause considerable forces to act upon the construction.

Furthermore, the known energy converter has a complex system of permanent magnets and/or coils and is therefore relatively expensive.

It is therefore an objective of the invention to provide a drive system of the type described above, wherein the inertial forces are relatively low.

It is a further objective to provide a drive system, wherein effective generation of electrical energy is made possible by using a relatively small number of magnets and a simple construction.

To this end, the energy generating device according to the invention is characterised in that the drive rods are each connected via a drive element, with a rotary body arranged around the cylinder shell, wherein the drive elements are provided with bearings that bear upon the rotary body and which, when in reciprocating motion, drive the rotary body in rotation about the longitudinal axis.

By applying the rotary body that can rotate around the cylinder shell, the opposed oscillating motion of the oppositely arranged piston bosses can effectively be converted into a rotary motion. Because all forces acting upon the rotary body are transmitted by roller bearings or ball bearings, the mechanical energy losses are lower than those for a known piston-crankshaft combination, in which the sliding piston is subjected to heavy transverse loads by the connecting rod.

The invention relates to electromagnetic as well as to mechanical rotary bodies, or combinations thereof. The rotary body can, for example, comprise one or more gear rings and can form part of a transmission system. The rotary body can then drive a machine or a vehicle's propulsion mechanism, such as wheels or an airscrew or propeller. The rotary body can also comprise magnetic elements such as coils and/or permanent magnets that rotate within a magnetic field for generating electrical power. In that case it is advantageous that, in spite of the relatively large diameter of the rotary body, a compact unit can still be obtained since, with a larger diameter of the rotary body, the circumferential speed of the magnetic elements at the gap is also increased, thereby increasing the efficiency of the relatively expensive magnets.

In one embodiment, the rotary body comprises a contoured rim or chase around the longitudinal axis that extends partially along the longitudinal axis, wherein the bearings of the drive elements, as they move linearly along the longitudinal axis, also move along the contour of the rotary body. The contour can comprise a wave in a hobbed form. By using the wave profile, a four-stroke effect can be obtained, for example, and the strokes of the piston bosses can be varied. By lengthening the expansion stroke in respect of the compression stroke, for example, the thermal efficiency can be increased.

In one embodiment, the drive elements can comprise a first frame that is connected with a first drive rod and a second frame that is connected with a second drive rod, wherein each frame is essentially U-shaped with two arms arranged along the longitudinal axis with the bearings located on the extremities of the arms, wherein the planes of the U-shaped frames are arranged at an angle to each other, preferably transversely in relation to each other. The drive rods can be efficiently coupled with the rotary element by means of the U-shaped frames, wherein the frames being arranged transversely to each other causes the rotary body to be driven by both of the frames via a single curve path.

A piston boss, displaceable along the longitudinal axis in relation to the drive rod, can be arranged around each drive rod with an inlet and outlet opening directed towards a head face aligned towards a centerline of the combustion chamber, wherein the drive rod is provided with a valve which can be displaced by the drive rod in relation to the inlet and outlet opening. By connecting each of the piston bosses with the rotary body and/or with the drive elements to the exterior of the end sections of the cylinder shell via a piston boss drive element, the desired timing of said bosses, and thus the relative timing of the inlet stroke, compression stroke, combustion stroke and outlet stroke, can be achieved in a robust, mechanical manner. Since only one valve is required for each piston, the opening can be at a maximum, which enables a rapid gas exchange without great pressure losses.

In yet another embodiment of a drive system according to the invention, the head face of the piston boss comprises a valve that is seated against and seals an inner face of the combustion chamber, as well as a stem and a chamber, wherein the drive rod passes through the stem and can be displaced so that its valve can be seated and sealed against the valve seat, wherein the valve seat comprises a ring with a number of radially positioned and mutually spring-connected fingers that end in a ring enclosing a circumferential rim of the valve, which ring lies seated and sealed against an inner wall of the cylinder shell. Due to the spring action of said fingers, a high clamping and sealing pressure can be exerted by the valve on the drive rod of the exhaust piston boss, so that the valve sealing is very favourable at the high pressures that occur during the expansion stroke.

For a system using direct fuel injection, a fuel delivery channel can extend via a drive rod up to the valve, whereby an injection nozzle extends past the valve from the drive rod into the combustion chamber. Due to the fixed arrangement of the injection nozzle, a fuel-air mixture can be injected in an optimal location within the combustion chamber in an axially and radially symmetrical manner in order to achieve a high thermodynamic efficiency.

Figure 2:
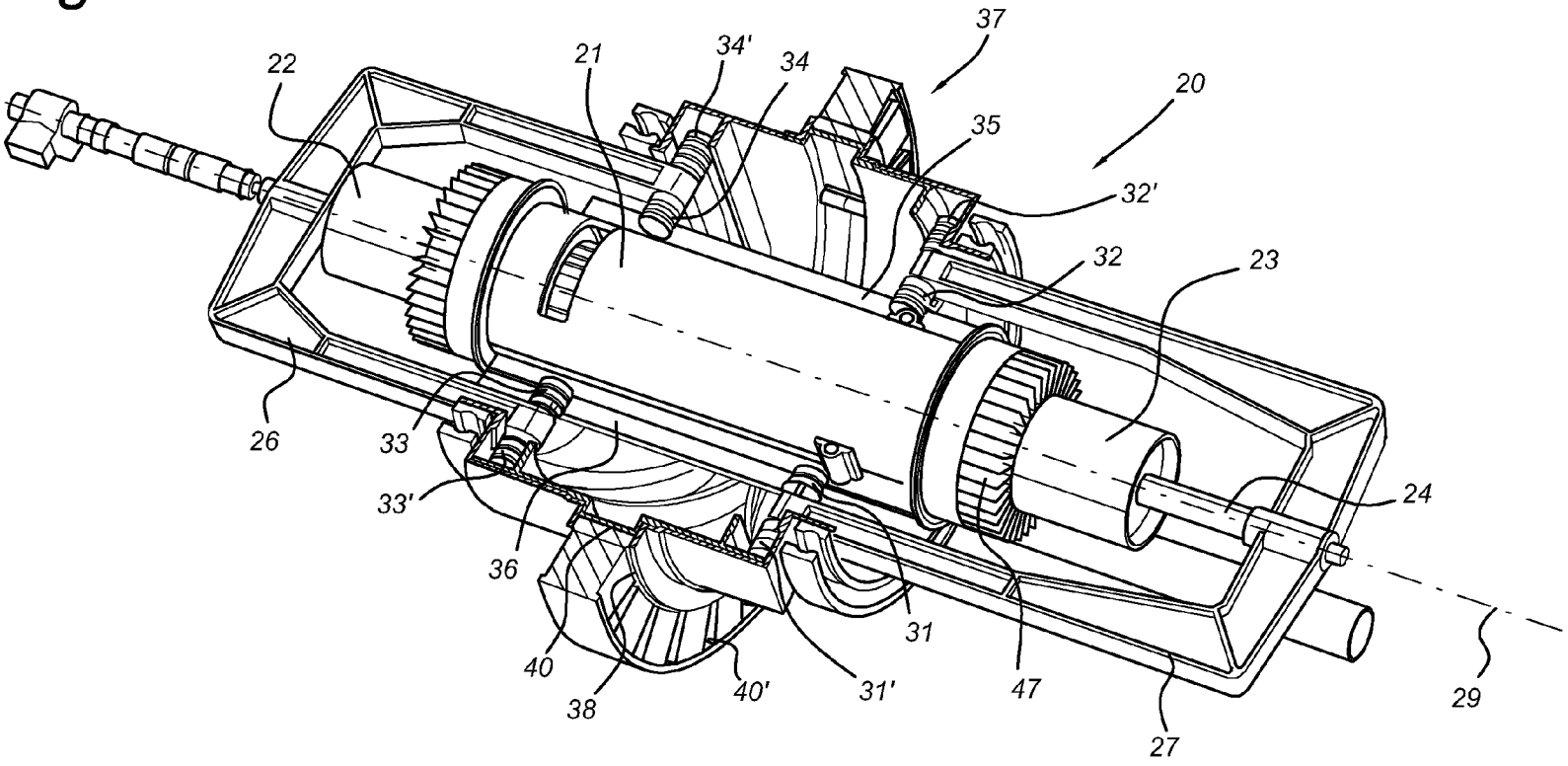
Figure 3:
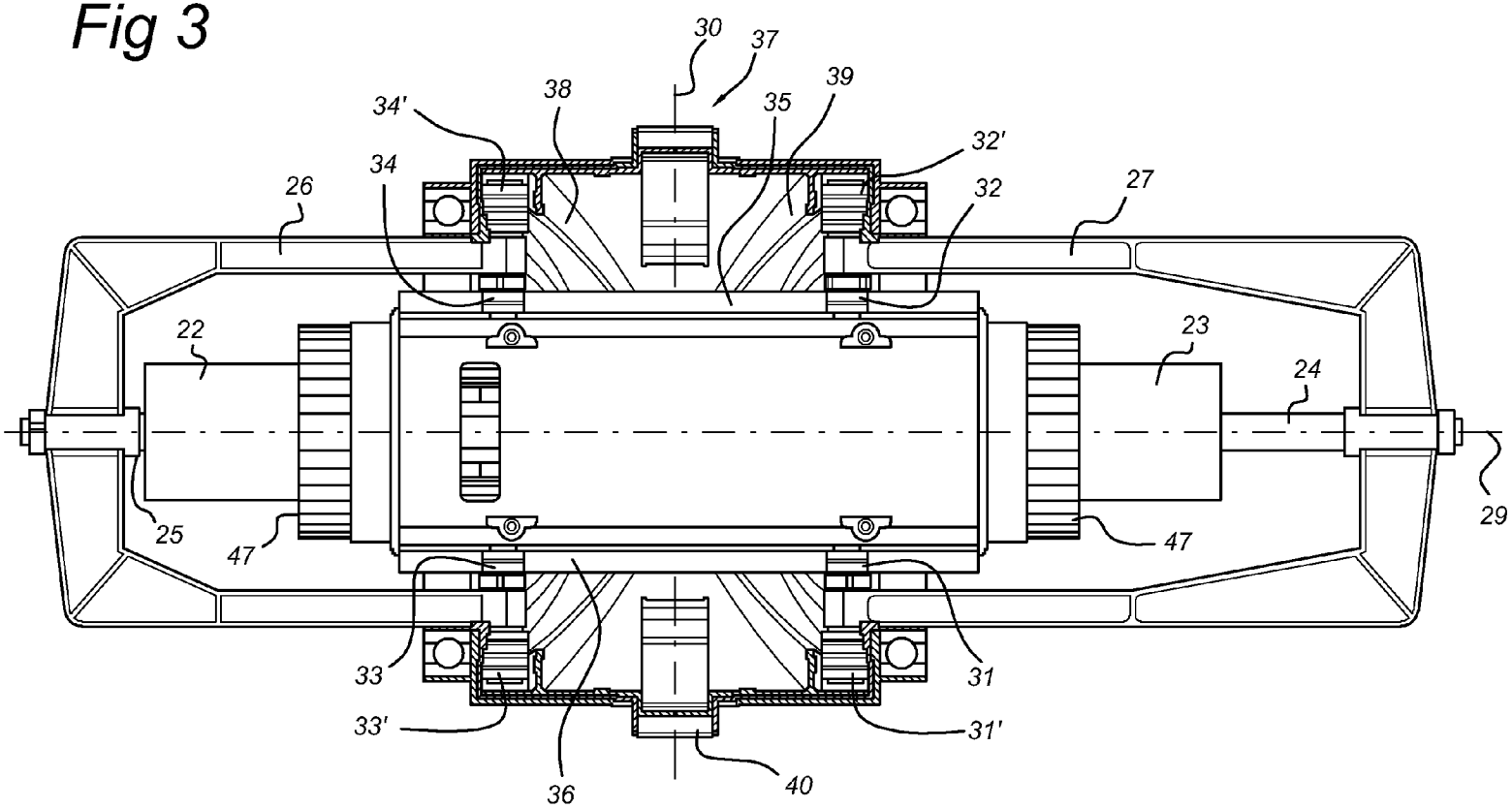
Figure 4:
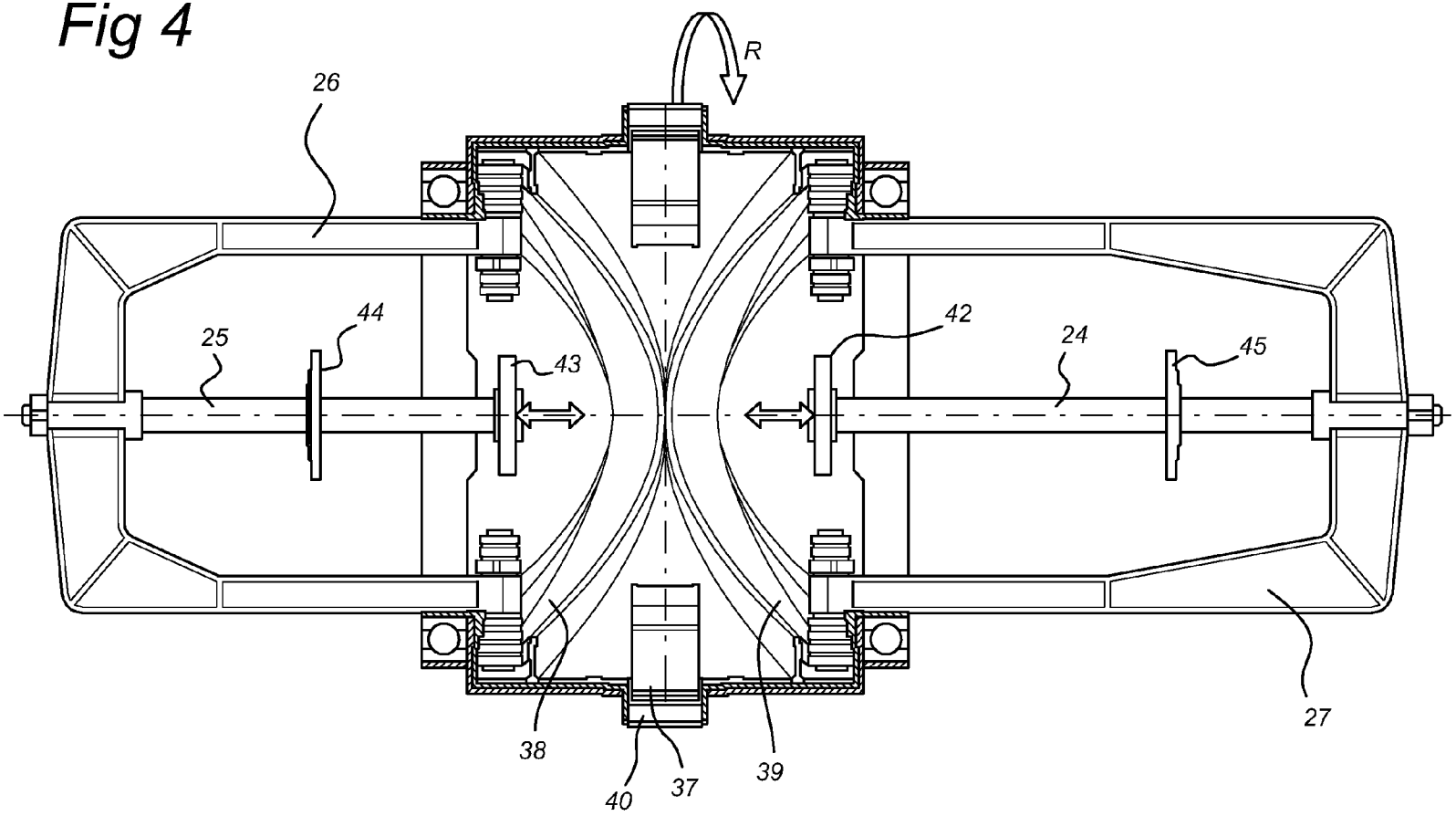
Figure 5:
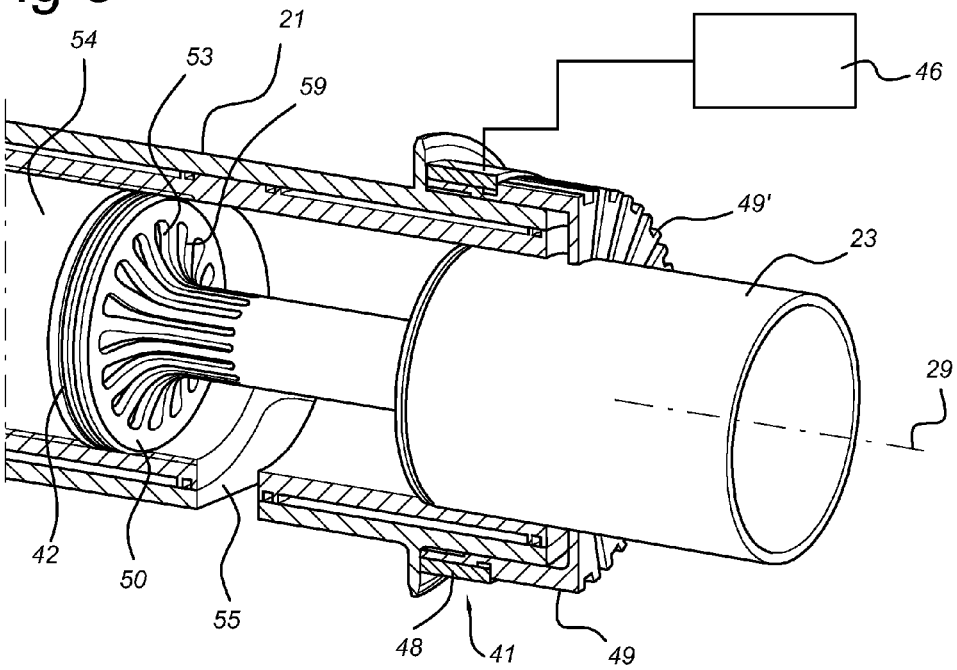
Figure 6:
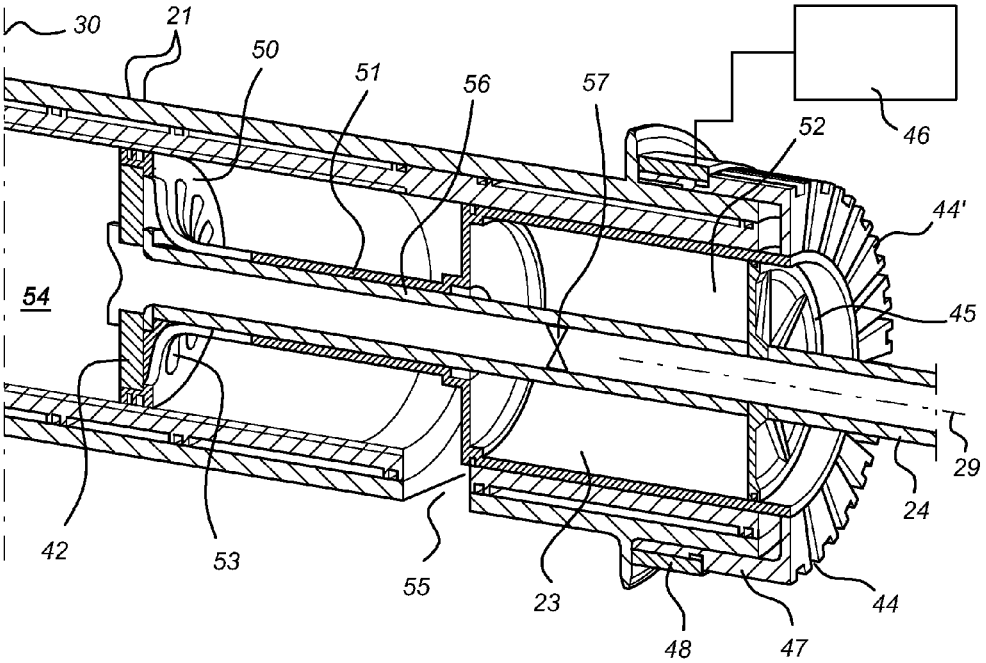
Figure 7:
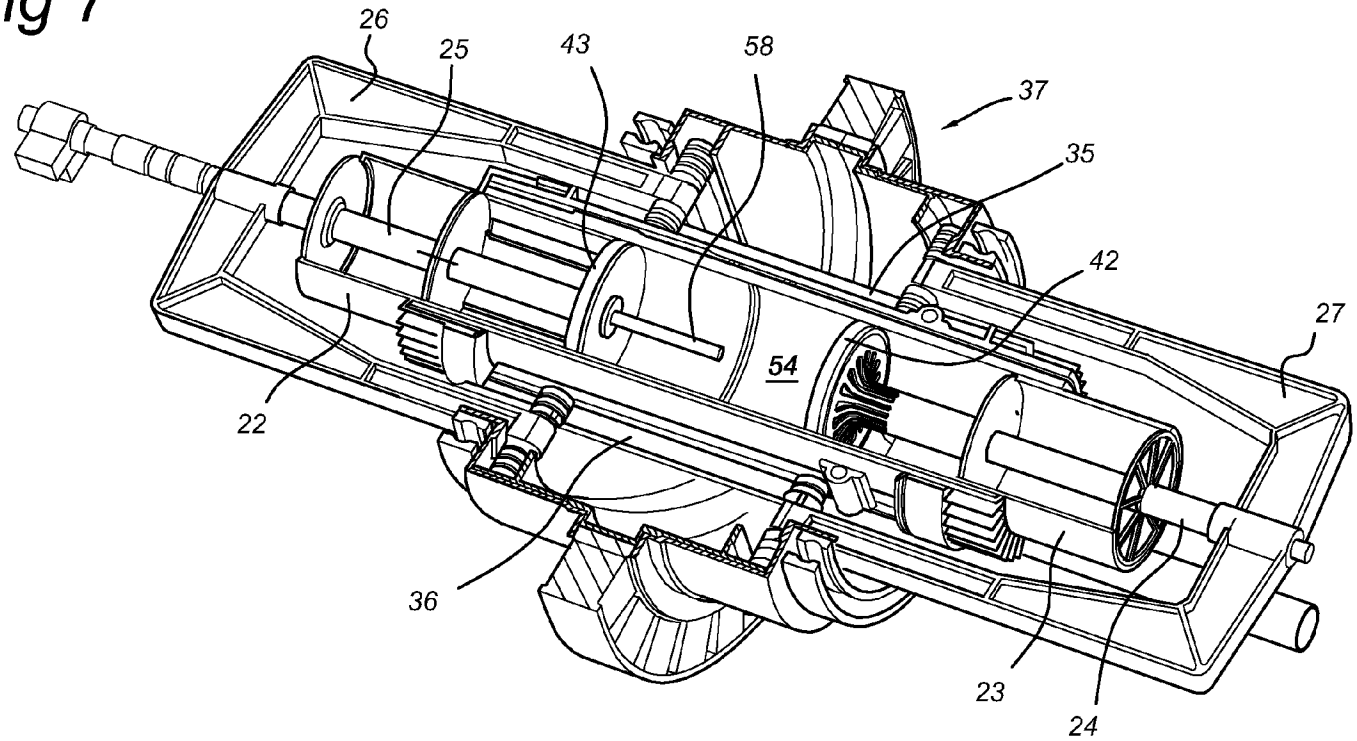
Figure 8:
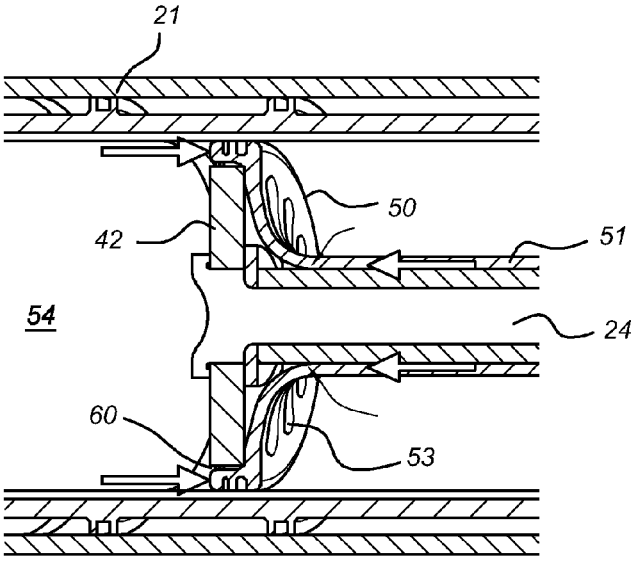
Figure 9:
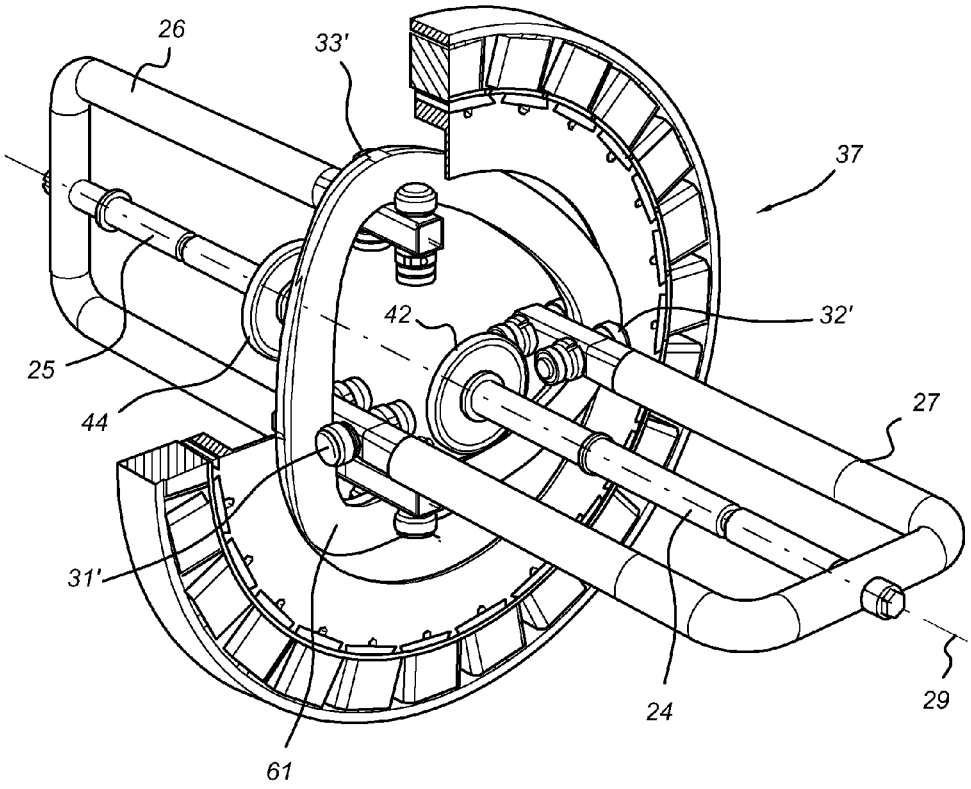
Figure 10:
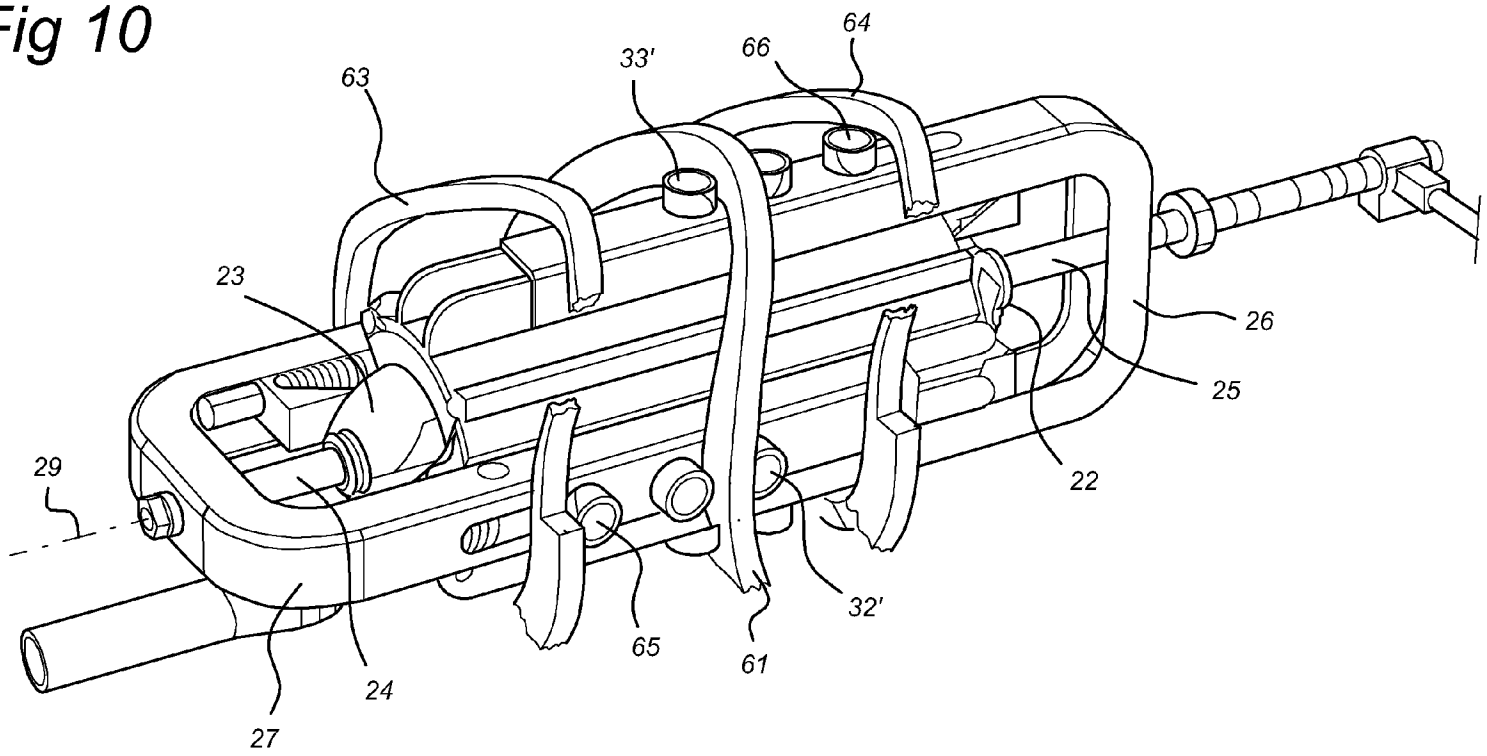
Figure 11:
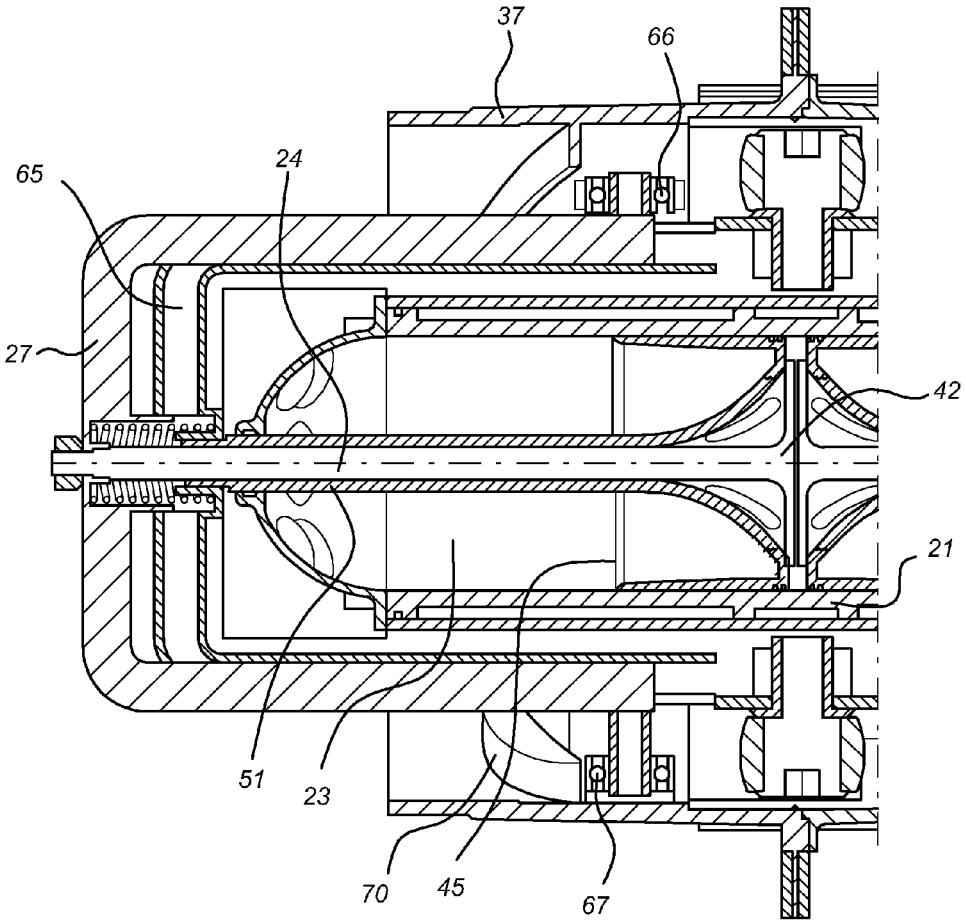

Several embodiments of a drive system according to the invention, in particular a generator, are explained in further detail below with reference to the accompanying drawing. In the drawing:

FIG. 1 shows a known generator with floating pistons according to the prior art, FIG. 2 shows a partially cut-away perspective view of a drive system according to the invention, having a rotor driven by a frame, FIG. 3 shows a partially cut-away top view of the drive system according to FIG. 2, FIG. 4 shows the drive system according to FIG. 3 in which the outer cylinder is omitted, FIG. 5 shows a perspective view of the outlet piston boss and the valve with spring mounted fingers, FIG. 6 shows a cross-section through the outlet piston boss according to FIG. 5, FIG. 7 shows a cut-away view of a drive system with a fixed arrangement of a fuel injection nozzle, FIG. 8 shows a detail of the valve of the outlet piston boss, FIG. 9 shows an embodiment with two frames, both being arranged perpendicular to each other, and a single curve path of the rotor, FIG. 10 shows an embodiment in which the piston bosses are each coupled with the rotor via their own frames, and FIG. 11 shows a partially cut-away view of a piston boss frame that is connected to the frame of the drive rods via a spring element.

FIG. 1 shows a known embodiment of a drive system according to PCT/NL2007/050160 by the current applicant, comprising an outer cylinder 1 in which there is an inlet port 2 and an outlet port 3. Two piston bosses 4, 4' move coaxially in opposing directions within the outer cylinder 1. Drive rods 5, 5' can be displaced within the piston bosses 4.4' and are connected via their respective parts arranged on the outer side of the cylinder 1 with a coil 7, 7' for generating electrical power. Each drive rod 5, 5' has a valve 8, 8' that lies seated against a valve seat in a head face of the piston bosses 4, 4' and which encloses the space within the piston bosses 4, 4' or connects with the central combustion chamber 10.

A fuel-air mixture is delivered to the central combustion chamber 10 via the inlet port 2. An ignition means 11 ignites the fuel-air mixture in said central combustion chamber 10 so that the resulting pressure build-up displaces the piston bosses 4, 4' and the drive rods 5, 5' outwardly in opposed axial directions. After displacement of the piston boss 4' to its outer dead point (ODP), where the piston boss is temporarily retained whilst the drive rod 5' returns to the central position, the outlet gases are exhausted via the outlet port 3.

The chambers 13, 13' defined by the piston bosses 4, 4 can be brought into connection with the inlet port 2 and the outlet port 3 respectively via the openings 12, 12' in the outer wall of the piston bosses 4.4'. Connected to each drive rod 5, 5' is a displaceable auxiliary piston 14, 14' incorporated within the piston bosses 4, 4', which is displaceable within a gas-filled second chamber 15, 15' of the piston bosses 4, 4'. A retaining device, in the form of a magnetic sleeve 17, 17' of the piston bosses 4, 4' and a stationary field coil 18, 18', periodically retains the piston bosses so that the axial displacement of the piston bosses is interrupted near to their inner dead point (IDP) or outer dead point (ODP) positions.

The force exerted by the retaining device on the inlet piston boss 4 is at a maximum when said piston boss 4 is at the position near to the centerline of the combustion chamber 10 at the inner dead point (IDP) position. In this manner, when the drive rod 5 is drawn back, the valve 8 is freed from the valve seat. Subsequently, the fuel-air mixture can flow via the inlet port 2, the opening 12 and the head face of the piston boss 4, into the combustion chamber 10. Following the inlet stroke and during the inwardly directed compression stroke, the valves 8, 8' of the drive rods 5, 5' lie seated against and seal the head faces of the piston bosses 4, 4'. The expansion stroke follows after ignition of the fuel-air mixture and the piston bosses 4, 4', the head faces of which are closed off by the valves 8, 8', are pushed outwardly from the centre of the combustion chamber 10 to their outer dead point (ODP). At the outer dead point, the field coil 18' is energized so that the retaining force exerted on the outlet piston boss 4' is at a maximum and the valve 8' of the drive rod 5' comes free from the head face of the piston boss 4' when the drive rod 5' returns to the centre of the combustion chamber 10. The outlet gases are subsequently exhausted to the outlet port 3 via the head faces of the outlet piston boss 4' and the opening 12' by the closed piston boss 4 as it returns to the centre of the combustion chamber 10.

FIG. 2, FIG. 3 and FIG. 4 show an embodiment of a drive system 20 according to the invention. Within the outer cylinder 21, an inlet piston boss 22 and an outlet piston boss 23 are displaceable in axially opposed directions, symmetrically in relation to a perpendicular centerline 30. The drive rods 24, 25 of the drive system are each connected with a frame 26, 27 that is displaced in oscillation in the direction of the longitudinal axis 29 by the drive rods. Each frame 26, 27 has two inner rollers 31, 32, 33, 34 that are supported on linear or axial bearing tracks 35, 36 arranged on the outer side of the cylinder. The outer rollers 31', 32', 33' and 34' of the frames 26, 27 run in conical grooves 38, 39 of a magnetic element or rotor 37 that is rotatable around the axis 29. Permanent magnets 40 are connected to the rotor 37. The grooves 38, 39 follow the path of a wave profile hobbed onto a cylinder. The rotor 37 is rotated in one direction—that of arrow R in FIG. 4—by the linear displacement of the rollers 31'-34' along the longitudinal axis 29.

FIG. 4 shows the drive system 20 wherein the outer cylinder 21 is not shown and the valves 42, 43 and the rear pistons 44, 45, that are permanently fixed to the drive rods 24, 25 are shown.

By providing the rollers with convex contact surfaces, the grooves can presume a flat waved shape. If the rollers 31'-34' and the grooves 38, 39 have a conical shape, the circumferential speed of the rotor 37 can be made constant, i.e. the circumferential speed is the same for all axial positions of the rollers 31'-34' along the longitudinal axis 29.

It is also possible to vary the profile of the grooves 38, 39 so that the speeds and relative positions of the drive rods 24, 25 and piston bosses 22, 23 are such, that an optimal thermodynamic process is achieved. It is possible, for example, to make the expansion stroke larger than the compression stroke so that the thermodynamic efficiency is increased.

If the guides are provided with a single or double waved profile, a two-stroke or a four-stroke drive system can be obtained. Since the profile of the grooves 38, 39 is based upon a symmetrical wave form, the relative circumferential speed of a two-stroke drive system in relation to a four-stroke drive system or a four-stroke drive system with a variable stroke length is equal to the ratio of 4:2:1.

Because all forces are transmitted by roller and ball bearings, the mechanical losses are less than in a conventional piston-crankshaft mechanism in which the sliding piston is subjected to heavy transverse loads by the drive rod. Because the rotor 37 rotates around the central combustion chamber 10 within the cylinder 21, a compact unit can be obtained despite the large rotor diameter, whereby a larger diameter of the rotor 37 increases the circumferential speed of the permanent magnets 40 at the gap 38 with the stationary magnetic coils 40' of the drive system, thereby increasing the efficiency of the relatively expensive magnets.

FIG. 5 shows an embodiment of a retaining device 41 for retaining the outlet piston boss 23 at the outer dead point (ODP) by means of a clamping force exerted on the periphery of the piston boss 23 extending outwardly from the outer cylinder 21. To this end, a ring of piezo-segments 48 is energized via a control unit 46, which expands in the axial direction within a millisecond. This axial expansion of the piezo-segments causes the right-angled claws 49, 49' of a pressure boss 47 to move radially towards the axis 29, which results in a very high clamping force being exerted on the outer side of the outlet piston boss 23. The same type of retaining device can be used for the inlet piston boss 25. Due to the precise timing of the retaining device 41 by the control unit 46, the inlet stroke and the outlet stroke of the piston bosses can be tuned in a thermodynamically optimal manner.

FIG. 6 shows an embodiment of the outlet piston boss 23 and the drive rod 24 on the outlet side of the cylinder 21. At its central extremity, the drive rod 24 is provided with a disc-shaped valve 42, permanently connected thereto. This valve 42 lies seated against a valve seat 50 which is connected to a chamber 52 of the piston boss 23 by a hollow stem 51. A rear piston 45, permanently connected to the drive rod 24, is displaceably arranged within the chamber 52 of the piston boss 23. The drive rod 24 can be displaced in an axial direction within the piston boss 23, whereby the passages 53 in the seat are freed by displacing valve 42 away from said seat 50. When the passages 53 are freed, outlet gases generated in the central combustion chamber 54 can flow via the passages 53 towards the outlet port 55. During the outlet stroke, the piston rod 24 is displaced from the outer dead point (ODP) (on the right in FIG. 6) back to the perpendicular centerline 30 of the drive system 20, whilst the pressure boss 47 retains the piston boss 23 in place. After the pressure boss 47 has released the piston boss 23 again, the latter moves under influence of the force of pressure created by the rear piston 45 in the direction of the perpendicular centerline 30 until the valve 42 lies seated against and seals said valve seat 50.

During the expansion stroke, in which the drive rod 24 is displaced from its inner dead point (IDP) near to the perpendicular centerline 30 to the outer dead point, it is important that the valve 42 of the drive rod 24 is pushed forcefully against the seat 50 in order for this to result in a good seal. To this end, a connecting channel 56 is formed inside the drive rod that connects the central combustion chamber 54 with the chamber 23 so that, particularly in the start-up phase of the drive system 20, the desired pressure is built up in the chamber 52. To achieve this, a pressure-calibrated one-way valve 57 is incorporated in the line 56.

FIG. 7 shows an embodiment for direct fuel injection, for example in a diesel embodiment of the generator or engine according to the invention, via a fixed injection nozzle 58 arranged within the central combustion chamber 54. Said injection nozzle 58 runs through the hollow drive rod 25. Due to the position of the injection nozzle in the centre of the central combustion chamber 54, an optimal distribution of the injection orientations can be obtained from the injection jets, which are injected from multiple openings at the extremity of the injection nozzle inside the chamber 54. The fixed arrangement of the injection nozzle 58 can also be fed from a piezo-technically controlled injection system.

FIG. 8 shows, at a large scale, how said valve 42 of said drive rod 24 lies seated against the valve seat 50. The drive rod is arranged inside of the hollow stem 51 of the piston boss 23 and can be displaced in an axial direction. The pressures that occur in the combustion chamber 54 during combustion are very high so that the ring-shaped opening 60 between the valve 42 and the seat 50 would need to be small or the pressure in the chamber 52 of the outlet piston boss 23 would become too high. By fitting the hollow stem 51, according to embodiment of the invention, tightly around the drive rod 24 and allowing it to end in an impeller with radially arranged, oblique ribs 59 that run over the drive rod 24 with a bend, when an open opening 60 is applied, this allows exhaust gases to flow freely towards the outlet port and, when the valve 42 is closed as a result of the gas pressure in the chamber 52 of the outlet piston boss, the seat 50 is pressed by the ribs of the drive rod 24 so that, even at high pressures, valve 42 retains its position, sealed against said valve seat 50.

FIG. 9 shows an embodiment in which the frame 27, that is connected to the drive rod 24, is turned 90 degrees in relation to the frame 26 that is connected to the drive rod 25. The rollers 31', 32' of frame 27 and the rollers 33', 34' of frame 26 are formed by roller pairs that bear on both sides upon a curve track 61, that can rotate with the rotor 37 about the longitudinal axis 29. By turning the frames 26, 27 with the guide rollers at 90 degrees in relation to each other, it is sufficient for a single rotation of the curve track 61 to convert the opposed oscillation of both drive rods to cause a rotation of the rotor 37.

FIG. 10 shows an embodiment whereby the inlet and outlet piston bosses 22 and 23 are connected via rollers 65, 66 with additional rotating curve tracks 63, 64. In this manner, the piston bosses can be given an additional opening stroke. This four-stroke action is achieved by arranging four curve tracks or two curve tracks with two-stage profiles in the rotary part.

FIG. 11 shows an embodiment in which the piston boss 23 is connected via the hollow stem 51 on the outside of the cylinder 21 with a piston boss frame 65. The piston boss frame 65 is connected via a spring element with the frame 27, and via rollers 66, 67, with a groove 70 in the rotor 37. In this manner the piston bosses 22, 23 are driven in oscillation in the direction of the longitudinal axis by the rotor 37 and a reliable mechanical valve control is achieved, thus enabling a large variation in the timing and of the opening and closing speed.

The invention claimed is:

1. An electric power generating system (20) provided with a cylinder shell (21) with two end sections and, inside the cylinder shell, a central combustion chamber (54) with two bodies arranged therein, which can move in axially opposed directions within the combustion chamber, wherein a drive rod (24, 25) extending along the longitudinal axis (29) of the cylinder shell (21) is connected to each piston body and extends outwardly from one respective end part of the cylinder shell (21) with a drive end, the drive ends being reciprocated along the longitudinal axis without rotating, wherein the drive ends are each connected via a drive element with a rotary body (37) comprising one or more magnetic elements (40) for generating electric power, the rotary body being of a relatively large diameter and being situated around the cylinder shell (21) and rotatable around the longitudinal axis (29), wherein the drive elements each comprise a non-rotating reciprocating frame (26) that is connected with a respective drive end, the frame being essentially U-shaped with two arms arranged parallel to the longitudinal axis at a distance from the cylinder shell, with bearings (31-34, 31'-34') located on the extremities of said arms, that bear upon a linear track (35,36) along an outer side of the cylinder shell and on the rotary body and that, when in reciprocating motion, drive the rotary body to cause rotation about the longitudinal axis (29).

2. The electric power generating system according to claim 1, wherein the rotary body (37) comprises a power transmission element for transmitting the rotation of the rotary body to a further rotary body.

3. The electric power generating system according to claim 1, wherein the rotary body (37) comprises a contoured rim or chase (38, 39, 70) around the longitudinal axis (29) that extends partially along the longitudinal axis, wherein the bearings (31-34; 31'-34') of the drive elements (26, 27), as they are displaced linearly along the longitudinal axis (29), are also displaced along the contour of the rotary body.

4. The electric power generating system according to claim 1, wherein said drive elements comprise a first frame (26) that is connected with a first drive rod (24) and a second frame (26) that is connected with a second drive rod (25), wherein each frame is essentially U-shaped with two arms arranged along the longitudinal axis with the bearings (31-34, 31'-34') located on the extremities of said arms, wherein the surfaces of the U-shaped frames are arranged at an angle to each other, preferably transversely in relation to each other.

5. The electric power generating system according to claim 1, wherein a piston boss (22, 23), displaceable along the longitudinal axis in relation to said drive rod, can be arranged around each drive rod (24, 25) with an inlet and outlet opening directed towards a head face aligned towards a centerline (30) of the combustion chamber (54), wherein the drive rod (24, 25) is provided with a valve (42, 43) which can be displaced by said drive rod in relation to the inlet and outlet opening (53, 60).

6. The electric power generating system according to claim 5, wherein the piston bosses (22, 23) are each connected outside of the end sections of the cylinder shell (21) via a piston boss drive element (65) with the rotary body (37) and/or with the drive elements (26, 27).

7. The electric power generating system according to claim 5, wherein the head face of the piston boss (22, 23) comprises a valve seat (50) that sits against and seals an inner face of the cylinder shell (21), as well as a stem (51) and a chamber (52), wherein said drive rod (24, 25) passes through the stem (51) and can be displaced so that its valve (42) can be arranged seated and sealed against the valve seat (50), wherein the valve seat comprises a ring with a number of radially positioned and mutually spring-connected fingers (59) that end in a ring enclosing and falling within a circumferential rim of said valve, which ring lies seated and sealed against an inner wall of the cylinder shell (21).

8. The electric power generating system according to claim 5, wherein a fuel delivery channel extends via a drive rod (25) up to the valve (43), wherein an injection nozzle (58) extends past the valve of said drive rod and into the combustion chamber (54).

9. The electric power generating system according to claim 1, wherein the compression stroke is shorter than the expansion stroke.

10. The electric power generating system according to claim 2, wherein the rotary body (37) comprises a contoured rim or chase (38, 39, 70) around the longitudinal axis (29) that extends partially along the longitudinal axis, wherein the bearings (31-34; 31'-34') of the drive elements (26, 27), as they are displaced linearly along the longitudinal axis (29), are also displaced along the contour of the rotary body.

11. The electric power generating system according to claim 6, wherein the head face of the piston boss (22, 23) comprises a valve seat (50) that sits against and seals an inner face of the cylinder shell (21), as well as a stem (51) and a chamber (52), wherein said drive rod (24, 25) passes through the stem (51) and can be displaced so that its valve (42) can be arranged seated and sealed against the valve seat (50), wherein the valve seat comprises a ring with a number of radially positioned and mutually spring-connected fingers (59) that end in a ring enclosing and falling within a circumferential rim of said valve, which ring lies seated and sealed against an inner wall of the cylinder shell (21).

12. An electric power generating system (20), comprising:

a cylinder shell (21) with two end sections and a longitudinal axis (29);

a central combustion chamber (54) located inside the cylinder shell;

two piston bodies arranged in the central combustion chamber and that move in axially opposed directions within the central combustion chamber;

two non-rotating, reciprocating frames (26, 27) located exterior to the cylinder shell (21) that are displaced in oscillation in a direction of the longitudinal axis (29), each frame being U-shaped with two arms arranged parallel to the longitudinal axis and spaced apart from an exterior of the cylinder shell (21);

two drive rods (24, 25) with respective drive ends, each drive rod (24, 25) being connected to a respective one of the frames (26, 27) and extending along the longitudinal axis (29) of the cylinder shell (21), each drive rod (24, 25) connected to a respective one of the piston bodies, each drive rod extending outwardly from one respective end section of the cylinder shell (21) to the exterior of the cylinder shell (21) with the drive ends being reciprocated along the longitudinal axis without rotating;

a drive element with a rotary body (37) comprising a magnetic element (40) that generates electric power, the rotary body being situated around the cylinder shell (21), the rotary body (37) and the magnetic element (40) being rotatable around the cylinder shell (21) and rotatable around the longitudinal axis (29), the drive element being connected to each of the frames, the drive ends of each drive rod being connected to each other via the two frames (26, 27) and the rotary body (37); and bearings (31-34, 31'-34') located on extremities of the two arms of each frame and bearing upon a linear track (35, 36) along an outer side of the cylinder shell (21) and on the rotary body (37), wherein, when the drive rods are in reciprocating motion, i) the reciprocating motion of the drive rods displace the frames in oscillation, and ii) the frames, via the bearings, drive the rotary body (37) and the magnetic element (40) in a direction (R) about the longitudinal axis (29).

13. The electric power generating system (20) of claim 12, further comprising:

conical grooves (38, 39) on the rotary body (37), wherein, the bearings (31-34, 31'-34') comprise i) two inner rollers (31-34) supported on the bearing tracks (35, 36), and ii) outer rollers (31'-34') that run in the conical grooves (38, 39), and the rotary body (37) is rotated by linear displacement of the outer rollers (31'-34') along the longitudinal axis (29).

* * * * *